US005185941A

United States Patent [19]

Dongelmans

[11] Patent Number: 5,185,941

[45] Date of Patent: Feb. 16, 1993

[54] DRYER BLOWER CLEANOUT DOOR ASSEMBLY

[75] Inventor: Anthony A. Dongelmans, Bryan, Ohio

[73] Assignee: Challenge Industries, Bryan, Ohio

[21] Appl. No.: 873,643

[22] Filed: Apr. 23, 1992

Related U.S. Application Data

[63] Continuation of Ser. No. 531,946, Jun. 1, 1990, abandoned.

[51] Int. Cl.[5] ..... F04B 39/14; F04B 17/00

[52] U.S. Cl. ..... 34/242; 415/201; 417/359; 417/360; 454/355

[58] Field of Search ..... 34/242; 415/201, 214.1; 417/359, 360; 454/355

[56] References Cited

U.S. PATENT DOCUMENTS

| | | | |
|---|---|---|---|
| 1,453,416 | 5/1923 | Stanley | 417/359 |
| 1,713,946 | 5/1929 | Buckley | 417/359 |
| 2,594,688 | 4/1952 | Shapiro | 415/201 X |
| 2,619,021 | 11/1952 | Pfautsch | 98/42.07 X |
| 3,305,163 | 2/1967 | Sheppard | 415/201 X |
| 3,425,621 | 2/1969 | Greenheck | 415/201 X |
| 4,092,088 | 5/1978 | Nemesi | 415/201 X |
| 4,245,965 | 1/1981 | Brown | 417/360 |
| 4,768,424 | 9/1988 | Frenkler et al. | 98/42.11 X |

FOREIGN PATENT DOCUMENTS

| | | | |
|---|---|---|---|
| 2184534 | 6/1987 | United Kingdom | 98/42.11 |

OTHER PUBLICATIONS

Power Flow Brochure.

*Primary Examiner*—Henry A. Bennet
*Assistant Examiner*—Christopher Kilner
*Attorney, Agent, or Firm*—Renner, Otto, Boisselle & Sklar

[57] ABSTRACT

A blower cleanout door assembly including a door panel pivotally connected to a blower housing for supporting a blower assembly including a blower wheel and motor for swinging movement of the door panel between a closed position covering a blower wheel opening in the housing with the blower wheel within the housing for operation and an open position in which the blower wheel is swung exteriorly of the blower housing out through the blower wheel opening for ease of cleaning the blower wheel and blower interior.

12 Claims, 4 Drawing Sheets

DRYER BLOWER CLEANOUT DOOR ASSEMBLY

This is a continuation of copending application Ser. No. 07/531,946 filed on Jun. 1, 1990, abandoned.

FIELD OF THE INVENTION

The invention herein disclosed relates generally to a dryer blower cleanout door assembly and more particularly to a dryer blower including a swing-out door on which the blower assembly is mounted whereby when the door is opened, the blower assembly including the blower wheel is swung out of the dryer housing for ease of cleaning. The invention is also applicable to blowers used in other industrial equipment which could collect lint of other foreign material resulting in a need for easy access to the blower wheel or blower interior.

BACKGROUND OF THE INVENTION

An often used blower wheel in the dryer (laundry) industry is a radial blower in which the blades are arranged in a radial pattern. This type of blower is more or less self-cleaning from lint and threads commonly found in dryer air flow. However, the efficiency of radial blowers usually requires them to be rotated at a higher rpm than, for instance, a backward inclined blower wheel. This creates a noisy blower and it is often desired or may be a necessity to equip a dryer with a less noisy blower.

A backward inclined blower is generally quieter than a radial blower. Because of its higher efficiency when compared to a radial blower the backward inclined blower may be run slower and still deliver the same air capacity. However, the leading edge of this blower is more likely to trap lint and threads than the radial type blower. Also some laundries use detergents or laundry water additives which may leave a sticky residue on blower wheel blades which tends to increase the lint accumulation.

Lint collected on blower wheels may bring the wheels out of balance causing unwanted vibration and reduced bearing life. In the past, to clean lint from a blower required awkward access through a small cleanout door. These cleanout doors are commonly located at the bottom of the blower housing to facilitate removal of nuts and bolts and other foreign items which are drawn into the blower housing. Because of the size and location of these cleanout doors, the cleaning may not be properly done, thereby aggravating the out of balance condition.

A need therefore remains for a blower including a blower wheel of the backward inclined type which is easily accessible and will have the advantage of being cleaned more often as required and thus prolong bearing life and reduce down time.

SUMMARY OF THE INVENTION

The present invention provides a blower cleanout door assembly which allows quick, convenient access to a blower wheel for ease of cleaning, thereby preventing unbalance and prolonging bearing life.

Briefly, a blower cleanout door according to the present invention is designed for use on a dryer or other blower including a blower housing wheel and a motor. The blower cleanout door comprises a door panel dimensioned to cover the blower wheel opening. A blower support is attached to the door panel for supporting the blower assembly. The door panel is pivotally mounted to the blower housing whereby the door panel may be closed to seal the blower wheel opening and position the blower wheel for operation within the blower housing or opened to swing the blower wheel out through the blower wheel opening for ease of cleaning.

As will be appreciated, the blower cleanout door allows convenient access to the blower wheel and thus facilitates the cleaning of the blower wheel and blower interior, in order to minimize blower wheel unbalance and thereby prolong bearing life.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
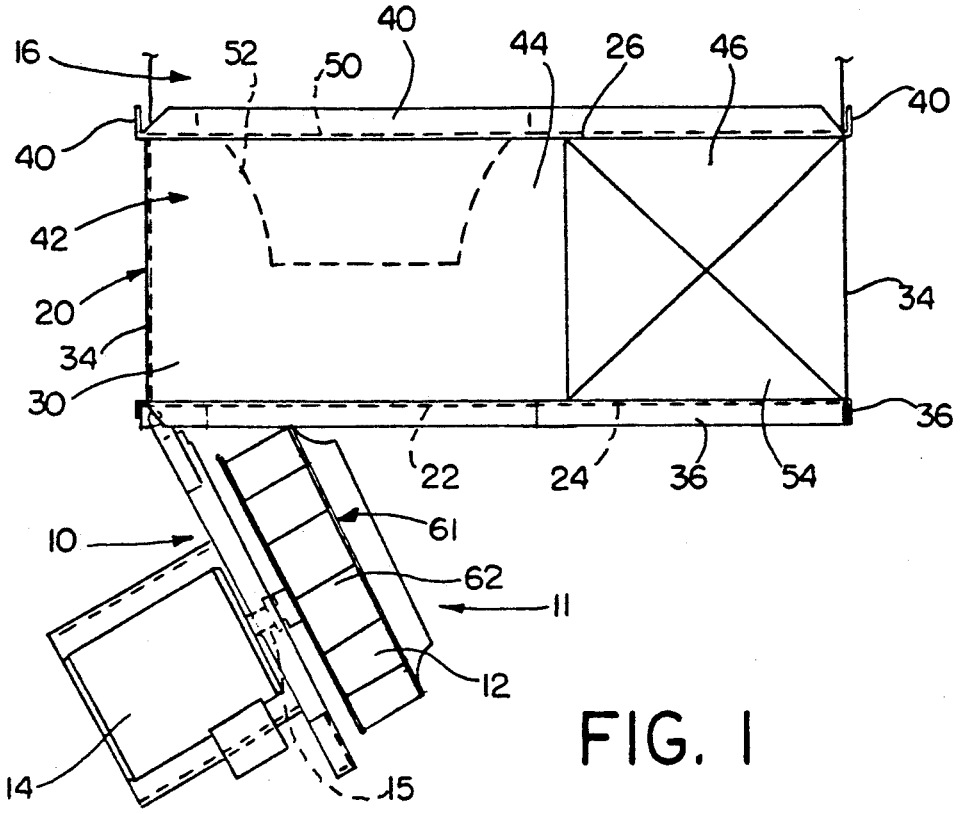
FIG. 1 is a top plan view of a blower cleanout door assembly mounted on a blower housing and swung open for service.
Figure 2:
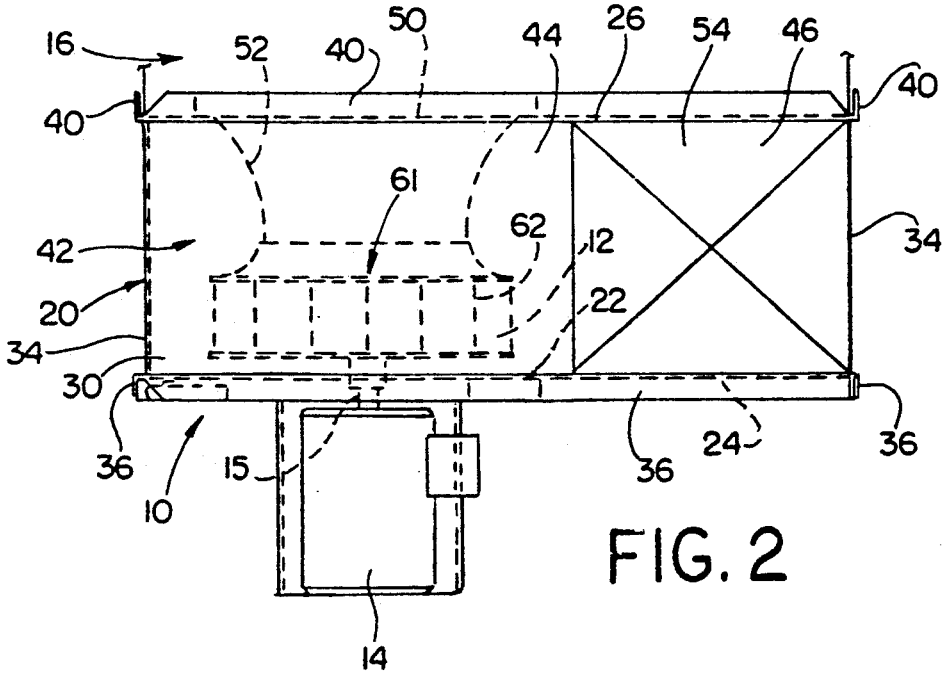
FIG. 2 is a view similar to that of FIG. 1 except the door assembly is closed for operation of the blower.

Referring now to the drawings and initially to FIGS. 1 and 2, a blower cleanout door according to the present invention is shown generally at 10. A blower assembly 11, which includes a blower wheel 12 and a motor 14, has its motor 14 securely mounted on the exterior of the door 10 with its shaft 15 extending through the door, and the blower wheel 12 directly mounted on the shaft 15 interiorly of the door. In the preferred embodiment, the door 10 is designed to be installed on an industrial size dryer 16 which includes a blower housing 20 having a blower wheel opening 22. However, the door is also applicable to blowers used in other industrial equipment which collect lint or other foreign material resulting in a need for easy access to the blower wheel or blower interior.

The door 10 is pivotally mounted on the blower housing 20. In this manner, the door 10 may be closed to seal the blower wheel opening 22 and position the blower wheel 12 for operation (see FIG. 2) and the door may be easily opened to clean the blower wheel 12 (see FIG. 1). Because the blower wheel 12 is easily accessible, it can be conveniently cleaned. This accessibility will result in more frequent and thorough cleaning of the blower wheel and thus prolong the useful life of the blower assembly 11 and reduce down time. Additionally, foreign items such as nuts, bolts, etc., can be easily removed from the blower housing. The dryer 16 may include an interlock switch (not shown) to prevent the blower wheel from rotating when the door is opened.

Figure 3:
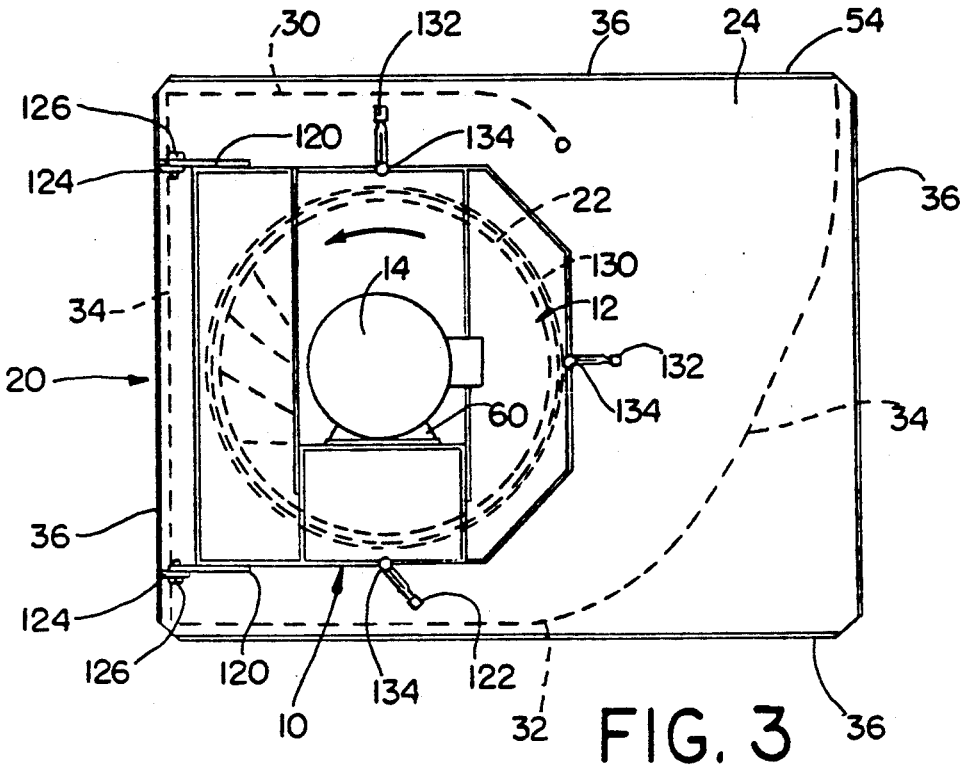
FIG. 3 is a front view of the door assembly of FIG. 2.
Figure 4:
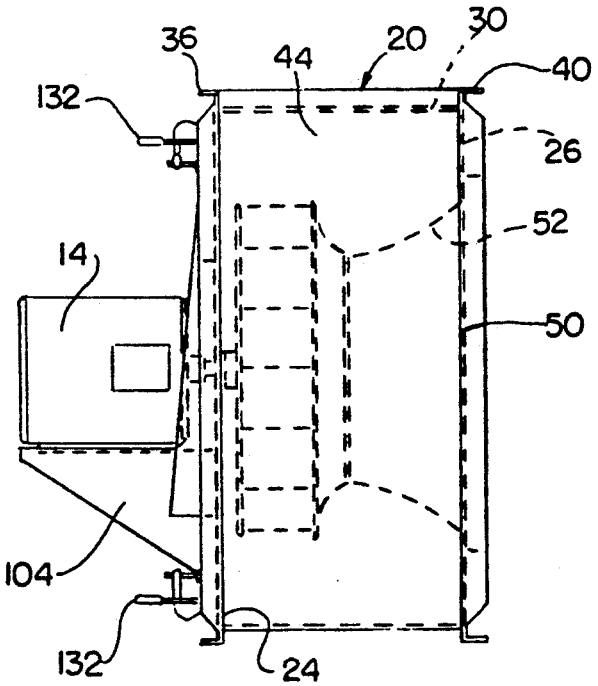
FIG. 4 is a side view of the door assembly of FIG. 2.

Referring now additionally to FIGS. 3 and 4, additional details of the blower housing 20 are shown. The housing 20 includes a front panel 24, a back panel 26, a top panel 30, a bottom panel 32 and two side panels 34. The front panel 24 includes four edges having outwardly directed flanges 36. Likewise, back panel 26 includes four edges having outwardly directed flanges 40.

The panels 24, 26, 30, 32 and 34 together form a box-like blower chamber 42. The chamber 42 may be divided into two subchambers, a blower wheel chamber 44 (to the left in FIGS. 1-3) and a blower discharge chamber 46 (to the right in FIGS. 1-3). The blower wheel chamber 44 accommodates the blower wheel 12 when the door 10 is closed, the blower wheel 12 being mounted on the inner end of the motor shaft 15 which extends through the blower opening 22 located in the front panel 26 into the blower wheel chamber 44. Air enters the blower wheel chamber 44 through an inlet opening 50 in the back panel 26 and passes through a blower inlet scroll 52. Both openings 22 and 50 are desirably circular and of approximately the same diameter. The diameter of opening 22 is necessarily sufficiently larger than the diameter of the blower wheel 12 to permit the blower wheel to be swung into and out of the blower wheel chamber 44 during closing and opening of the door 10.

Air discharged from the blower wheel 12 then travels to the blower discharge chamber 46 and exits through an outlet 54 in the top panel 30. Preferably the outlet 54 is a rectangular opening which will usually connect to an outlet duct (not shown). At this point, a portion of the air is desirably recirculated back into the dryer to recapture ±50 to 70% of the heat, and the balance of the air is expelled through an exhaust duct and lint collector (not shown).

Turning now to details of the blower assembly 11, it includes, as indicated above, a blower wheel 12 and a motor 14. The blower wheel 12 is mounted on the motor shaft 15. The motor 14 may be of a conventional type and includes a support base 60. The blower wheel 12 includes an impeller 61 having backward inclined blades 62 which point in the direction of rotation at the tip leading edge and in the direction opposite rotation at the trailing edge. This type of blower wheel is of a higher efficiency than radial type blowers conventionally used and thus is quieter because it can deliver the same air capacity at a slower speed.

Figure 6:
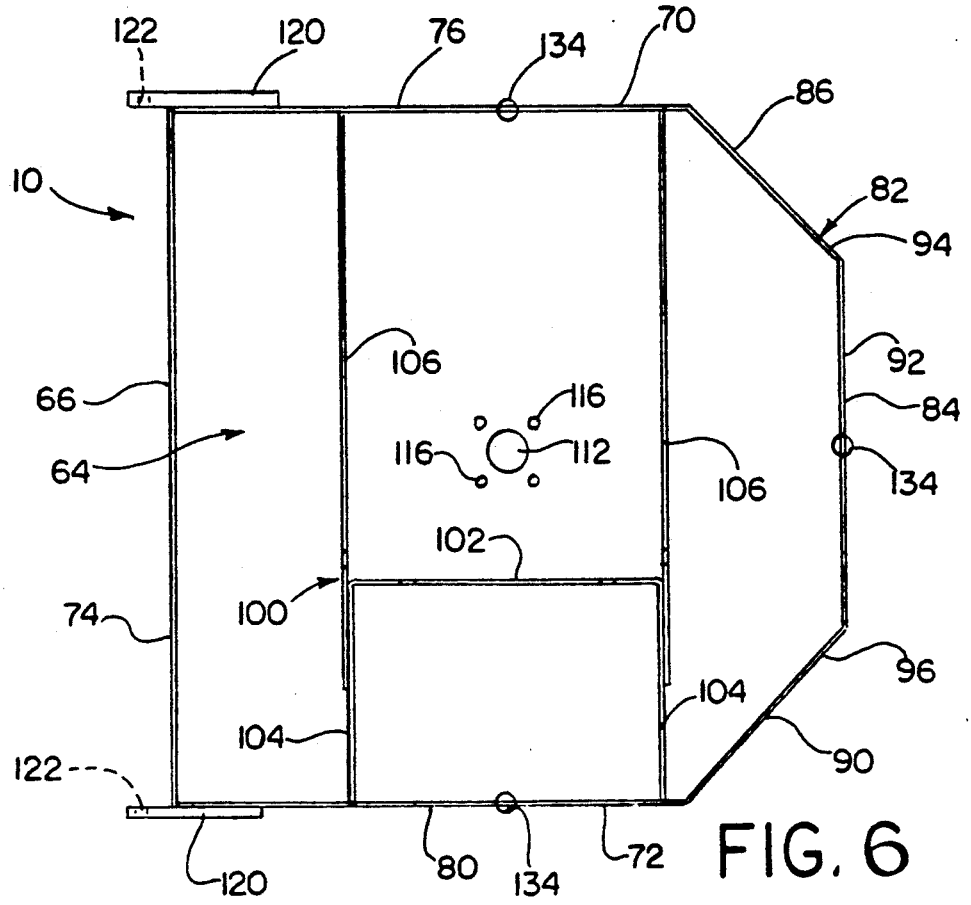
FIG. 6 is a front view of the door assembly of FIG. 5.
Figure 5:
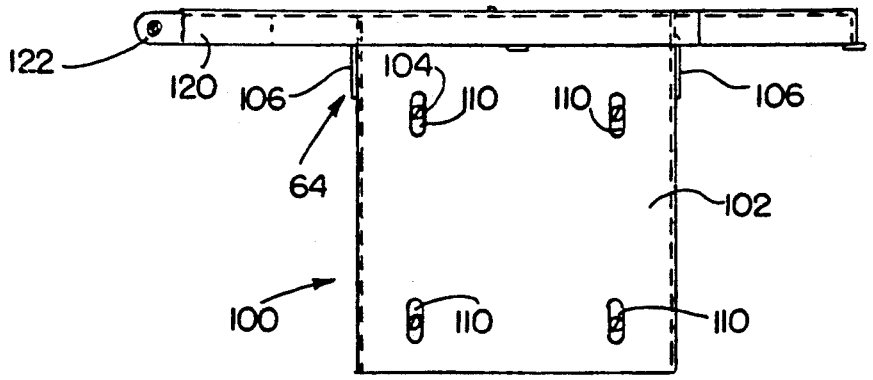
FIG. 5 is an enlarged top plan view of the door assembly isolated from the blower and blower housing.
Figure 7:
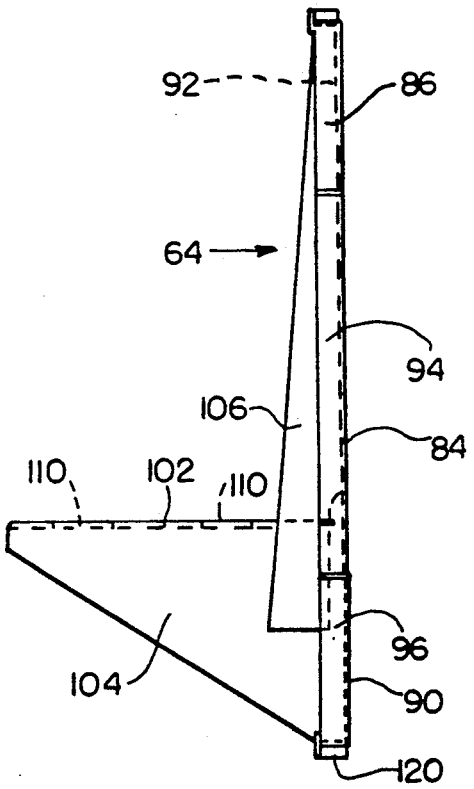
FIG. 7 is a side view of the door assembly of FIG. 5.

Referring additionally now to FIGS. 5-7, the door 10 is shown isolated from the dryer 16 and the blower assembly 11, and includes a door panel 64 dimensioned to cover the blower wheel opening 22. The door panel 64 is basically rectangular and, as seen in FIG. 6, includes a distal straight left side 66, straight top and bottom sides 70 and 72. The sides 66, 70 and 72 each include edge flanges 74, 76 and 80, respectively, which extend outwardly or in a direction away from the dryer 12 when the door is installed and closed. The door panel 64 also includes a proximate side 82 which has three edges 84, 86 and 90. While this side could have sharp corners, the three edges or chamfered corners allow more clearance when swinging the door open and allow easier access to the blower wheel for cleaning. One edge 84 is located in the center of the side 82 and is parallel to the side 66 and approximately half the length of side 66, whereas the other two edges 86 and 90 extend inward from opposite ends of the edge 84 at an angle of approximately 45°. The proximal sides (edges) 84, 86 and 90 include edge flanges 92, 94 and 96 which extend outwardly.

A blower support 100 is attached to the exterior of the door panel 64 for supporting the blower motor 14. The blower support 100 includes a motor platform 102 which extends perpendicularly outward from the door panel 64. The motor platform 102 is dimensioned to securely support the motor 14, and includes two vertical angled sides 104. Two support brackets 106, which may, for example, extend approximately 4/5 the height of the door panel, are welded to the blower support platform 102 to hold it in position.

To mount the blower assembly 11 onto the blower support 100, the motor 12 is placed on the motor platform 102 and secured thereto as by means of bolts 104 passing through the motor stand 60 and slots 110 (see FIGS. 3 and 5) in the platform. When the motor 12 is properly mounted, the motor shaft 15 extends through a shaft opening 112 in the door panel 64 to permit the blower wheel 12 to be connected to the shaft 15 on the opposite side of the door panel 64. A shaft seal (not shown) surrounds the shaft 15 on the motor side of the panel 64 and may be secured to the panel by bolts (not shown) passing through holes 116 surrounding the shaft opening 112.

The door 10 is pivotally mounted to the blower housing 20 by way of two hinge bars 120. The hinge bars are connected to the top and bottom sides 70 and 72 and more specifically are welded to the edge flanges 76 and 80. A portion of the hinge bars 120 extends beyond the distal side 66 of the panel 64. The outer ends of the hinge bars 120 have a pivot opening 122. The hinge bars 120 coordinate with shorter bars 124 which are attached to the blower housing 20 (see FIG. 3) and bolts 126 to pivotally mount the door 10 onto the blower housing.

When the door 10 is in its closed, operating position, it is of course important that the blower wheel opening 22 be sealed. To this end, a circular door seal 130 is fastened around the edge of the opening 22 (see FIG. 3). The seal 130 is preferably pressure sensitive adhesive sponge tape. Additionally, three over the center quick release clamps 132 may be mounted on the front panel 24 of the blower housing. Three clamping pads 134 are mounted on the door panel 62 (see FIG. 6). When the door 10 is closed, the clamps 132 clamp onto the door, at clamp pads 134, securely holding the door in closed operating position as shown in FIG. 3.

In view of the foregoing, it can now be appreciated that there is provided a blower cleanout door which allows access to the blower wheel in seconds and facilitates the cleaning of the blower wheel, thereby preventing unbalance and prolonging bearing life.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A blower comprising a blower housing having a blower wheel opening, a blower assembly including a blower wheel and a motor, and a blower cleanout door, said door comprising a door panel dimensioned to cover said blower wheel opening, a motor platform attached to an exterior side of said door panel, said motor platform extending perpendicularly outwardly from said exterior side of said door panel, said motor being mounted on said motor platform, said door panel having a shaft opening, said motor having a shaft extending from said motor through said shaft opening, said blower wheel being mounted on said shaft inwardly of said door panel, means for adjusting the position of said motor on said motor platform to obtain a desired spacing and orientation of said motor relative to said door panel, and pivot means pivotally mounting said door panel to said blower housing for swinging movement of said door panel between a closed position in which said door panel covers said blower wheel opening and said blower wheel is within said blower housing for operation and an open position in which said blower wheel is swung exteriorly of said blower housing out through said blower wheel opening for ease of cleaning said blower wheel.

2. A blower as set forth in claim 1 further comprising plural over center quick release clamp means mounted on said blower housing in spaced apart relation around said blower wheel opening for releasably clamping said door panel in the closed position.

3. A blower as set forth in claim 2 further comprising seal strip means secured around said blower wheel opening for sealing said blower wheel opening when said door panel is closed.

4. A blower as set forth in claim 1 wherein said door panel includes generally straight top and bottom sides and a pair of generally vertical sides, and said pivot means comprises a first pair of hinge bars respectively attached to said top and bottom sides adjacent one of said vertical sides, said first pair of hinge bars including protruding portions extending outwardly beyond said one vertical side of said door panel, a second pair of hinge bars attached to said blower housing, said second pair of hinge bars extending from said blower housing in underlying relation to said protruding portions of said first pair of hinge bars, and bolt means extending from said second pair of hinge bars through pivot openings in said first pair of hinge bars.

5. A blower as set forth in claim 4 wherein said one vertical side of said door panel is generally straight, and the other vertical side has chamfered corners to allow more clearance when swinging the door panel open and easier access to said blower wheel for cleaning.

6. A blower as set forth in claim 4 wherein said top and bottom sides have edge flanges which extend perpendicularly outward from said door panel, said first pair of hinge bars being welded to respective ones of said edge flanges.

7. A blower as set forth in claim 1 wherein said motor platform includes two vertically angled sides, and two support brackets extending a substantial portion of the height of said door panel for attaching said motor platform to said exterior side of said door panel.

8. In combination, a blower cleanout door, a blower housing having a blower wheel opening, and a blower assembly, said blower assembly comprising a blower wheel and a motor, said blower cleanout door comprising a door panel dimensioned to cover said blower wheel opening, a motor platform attached to an exterior side of said door panel, said motor platform extending perpendicularly outward from said exterior side of said door panel, said motor being mounted on said motor platform, said door panel having a shaft opening, said motor having a shaft extending from said motor through said shaft opening, said blower wheel being mounted on said shaft adjacent an interior side of said door panel, means for adjusting the position of said motor on said platform to obtain a desired spacing and orientation of said motor relative to said door panel, pivot means pivotally mounting said door panel to said blower housing for swinging movement of said door panel between a closed position in which said door panel covers said blower wheel opening and said blower wheel is within said blower housing for operation and an open position in which said blower wheel is swung exteriorly of said blower housing out through said blower wheel opening for ease of cleaning said blower wheel, and seal means for sealing said blower wheel opening when said door panel is closed.

9. The combination as set forth in claim 8 further comprising plural over center quick release clamp means mounted on said blower housing in spaced apart relation around said blower wheel opening for releasably clamping said door panel in the closed position.

10. In combination, a blower housing having a blower wheel opening, a blower cleanout door pivotally mounted on said blower housing, and a blower assembly, said blower assembly comprising a blower wheel and a motor, said blower cleanout door comprising a door panel dimensioned to cover said blower wheel opening, a motor platform attached to an exterior side of said door panel, said motor platform extending perpendicularly outward from said exterior side of said door panel, said motor being mounted on said motor platform, said door panel having a shaft opening, and said motor having a shaft extending from said motor through said shaft opening, means for adjusting the position of said motor on said motor platform to obtain a desired spacing and orientation of said motor relative to said door panel, said blower wheel being mounted on said shaft adjacent an interior side of said door panel, said door panel being pivotally movable between a closed position in which said door panel covers said blower wheel opening and said blower wheel is within said blower housing for operation and an open position in which said blower wheel is swung exteriorly of said blower housing out through said blower wheel opening for ease of cleaning said blower wheel and blower interior.

11. The combination as set forth in claim 10 further comprising plural over center quick release clamp means mounted on said blower housing in spaced apart relation around said blower wheel opening for releasably clamping said door panel in the closed position.

12. A blower as set forth in claim 1 wherein said means for adjusting comprises slot means in said motor platform extending in a direction perpendicular to said door panel, and bolt means extending through said slot means for securing said motor to said motor platform.

* * * * *